US012280903B2

(12) United States Patent
Bowman et al.

(10) Patent No.: US 12,280,903 B2
(45) Date of Patent: Apr. 22, 2025

(54) CONTAINER CARRIER

(71) Applicant: ILLINOIS TOOL WORKS INC., Glenview, IL (US)

(72) Inventors: Vincent Bowman, Highland Park, IL (US); Griffin E. Rustad, Chicago, IL (US); Hyunchul Kim, Chicago, IL (US); Jacob M. Fornof, Chicago, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 17/981,064

(22) Filed: Nov. 4, 2022

(65) Prior Publication Data

US 2023/0147374 A1 May 11, 2023

Related U.S. Application Data

(60) Provisional application No. 63/276,309, filed on Nov. 5, 2021, provisional application No. 63/276,296, filed on Nov. 5, 2021, provisional application No. 63/276,304, filed on Nov. 5, 2021.

(51) Int. Cl.

| | |
|---|---|
| ***B65D 71/50*** | (2006.01) |
| ***B65B 17/02*** | (2006.01) |
| ***B65D 25/28*** | (2006.01) |

(52) U.S. Cl.

CPC ..... *B65B 17/025* (2013.01); *B65D 25/2838* (2013.01); *B65D 71/502* (2013.01); *B65D 2571/0029* (2013.01); *B65D 2571/00444* (2013.01)

(58) Field of Classification Search

CPC ..... B65D 71/502; B65D 25/2383; B65D 2571/0029; B65D 2571/00444

USPC ..... 206/148, 149

See application file for complete search history.

(56) References Cited

U.S. PATENT DOCUMENTS

| | | | | |
|---|---|---|---|---|
| 3,868,140 | A * | 2/1975 | Gordon | B65D 71/004 206/139 |
| 4,372,598 | A * | 2/1983 | Quelch | B65D 71/50 206/427 |
| 5,535,879 | A | 7/1996 | Appleton | |
| 5,718,330 | A * | 2/1998 | Auffret | B65D 71/50 206/199 |

(Continued)

FOREIGN PATENT DOCUMENTS

| | | | |
|---|---|---|---|
| DE | 10 2018 005 250 | A1 | 1/2020 |
| FR | 1 221 954 | A | 6/1960 |
| WO | WO 95/08488 | A1 | 3/1995 |

OTHER PUBLICATIONS

EPO (Rijswijk, NL), English language version of the International Search Report, Form PCT/ISA/210, for International Application PCT/US2022/049120, Nov. 7, 2022 (6 pages).

(Continued)

*Primary Examiner* — Steven A. Reynolds

(74) *Attorney, Agent, or Firm* — Pauley Erickson & Swanson

(57) ABSTRACT

A container carrier for unitizing a plurality of containers that includes a first engagement means configured to engage a can and a second engagement means configured to engage a bottle, wherein the first engagement means and the second engagement means are generally superimposed upon each other.

7 Claims, 10 Drawing Sheets

(56) References Cited

U.S. PATENT DOCUMENTS

| | | | | |
|---|---|---|---|---|
| 5,735,562 | A | 4/1998 | Borg | |
| 6,050,399 | A * | 4/2000 | Pratt | B65D 71/50 206/161 |
| 6,394,517 | B1 | 5/2002 | Borg | |
| 6,715,810 | B2 | 4/2004 | Borg | |
| 7,108,128 | B2 * | 9/2006 | Borg | A45F 5/10 294/87.2 |
| 7,147,100 | B1 | 12/2006 | Borg | |
| 7,377,382 | B2 | 5/2008 | Borg et al. | |
| 7,588,275 | B2 | 9/2009 | Borg | |
| 7,614,495 | B1 * | 11/2009 | Smithers | B65D 71/50 206/153 |
| 7,823,943 | B2 | 11/2010 | Borg | |
| D721,598 | S | 1/2015 | Borg | |
| D722,891 | S * | 2/2015 | Borg | D9/752 |
| D757,548 | S | 5/2016 | Borg et al. | |
| 9,376,238 | B2 * | 6/2016 | Landow | B65D 71/504 |
| 9,517,859 | B2 | 12/2016 | Borg et al. | |
| D831,501 | S * | 10/2018 | Borg | D9/752 |
| 10,266,326 | B2 | 4/2019 | Borg et al. | |
| 10,293,998 | B2 | 5/2019 | Borg et al. | |
| 10,364,080 | B2 * | 7/2019 | Tetreault | B65D 71/50 |
| 10,399,742 | B2 | 9/2019 | Borg et al. | |
| 10,457,445 | B2 | 10/2019 | Borg et al. | |
| 10,518,952 | B2 | 12/2019 | Taylor et al. | |
| 10,892,283 | B2 | 1/2021 | Zhang et al. | |
| 11,001,428 | B2 | 5/2021 | Borg et al. | |
| 11,111,063 | B2 | 9/2021 | Borg et al. | |
| 2007/0296231 | A1 | 12/2007 | Borg | |
| 2019/0329951 | A1 * | 10/2019 | Borg | B65D 71/504 |
| 2021/0188511 | A1 * | 6/2021 | Gould | B65D 71/406 |
| 2021/0245940 | A1 * | 8/2021 | Borg | B65D 55/0863 |

OTHER PUBLICATIONS

EPO (Munich, DE), English language version of the Written Opinion of the ISA, Form PCT/ISA/237, for International Application PCT/US2022/049120, Nov. 7, 2022 (6 pages).

* cited by examiner

CONTAINER CARRIER

CROSS-REFERENCE TO RELATED APPLICATIONS

This application claims priority to U.S. Provisional Application, Ser. Nos. 63/276,296; 63/276,304; and 63/276,309, all filed on 5 Nov. 2021. These U.S. Provisional Applications are hereby incorporated by reference herein in their entirety and are made a part hereof, including but not limited to those portions which specifically appear hereinafter.

BACKGROUND OF THE INVENTION

Field of the Invention

This invention relates generally to beverage multipacks and, more particularly, to multipacks made up of a plurality of containers.

Description of Prior Art

Conventional container carriers are often used to unitize a plurality of similarly sized containers, such as cans, bottles, jars and boxes and/or similar containers that require unitization. Flexible plastic ring carriers and paperboard boxes are two such conventional container carriers.

However, with growing concerns surrounding the environmental impact of improper disposal of plastic waste, manufacturers are transitioning offerings to best support a circular economy. One such solution is plastic ring carriers made from 50% post-consumer recycled content. This carrier is operationally efficient, competitively priced, simple, and has a low carbon footprint in comparison to other beverage multipack alternatives. Today, this solution is not considered 100% curbside recyclable by the FTC Green Guide because 60%+consumers cannot recycle flexible plastics. Multi-packaging systems are generally used in the beer, soft drink, and general products industries. A new and innovative beverage multipacking solution is desirable that includes a 4, 6, 8, and/or 12 beverage capacity. A preferred design is produced using 100% curbside recyclable rigid plastics, like HDPE or PET. These carriers would be applied on PET bottles and/or aluminum cans.

SUMMARY OF THE INVENTION

The invention generally relates to a container carrier for unitizing a plurality of containers into a multipack. According to one embodiment the subject container carrier is configured to unitize cans or bottles with the same device.

A preferred embodiment of the subject invention is made from materials that are 100% curbside recyclable, in particular rigid PET and HDPE plastics that can enter most municipal recycling streams. This invention focuses on end-user needs and structural plastics that can easily be recycled. A solution that is meaningful, practical and makes a positive impact to encourage people to recycle is desired.

Other objects and advantages will be apparent to those skilled in the art from the following detailed description taken in conjunction with the appended claims and drawings.

DETAILED DESCRIPTION OF THE INVENTION

The present invention provides a container carrier to unitize a plurality of containers into beverage multipacks. The container carrier 100, 200, 300 according to this invention is shown in FIGS. 1-17 and examples of unitized multipacks are shown in FIGS. 4-6, 10-12, 16 and 17.

According to a preferred embodiment of this invention, the container carrier is injection molded or otherwise formed from high density polyethylene (HDPE). Alternatively, PET or HDPE plastics may be used. Preferably, the material is generally rigid and 100% post-consumer recyclable in most or all markets. The container carrier as described is thus molded or formed into a plurality of ribs and/or struts that together define the structures described below and shown in the figures.

In a preferred embodiment of this invention, the container carrier includes a plurality of container receiving openings forming an array of rings corresponding with a desired size of multipack. As such, although FIGS. 1-17 show six container receiving openings in a 2×3 array, other desired container carriers may be 2×2 for a four pack, 2×4 for an eight pack, or other desired arrays forming a desirable quantity multipack size.

As shown in the subject drawings, the container carrier 100, 200, 300 for unitizing a plurality of containers includes a first engagement means configured to engage a can 20 and a second engagement means configured to engage a bottle 30, wherein the first engagement means and the second engagement means are generally superimposed upon each other. "Superimposed" as used throughout the specification and claims is generally defined as wherein a first engagement means and a second engagement means are aligned and/or positioned and/or laid over each other, in either order, typically so that both are still evident.

Figure 1:
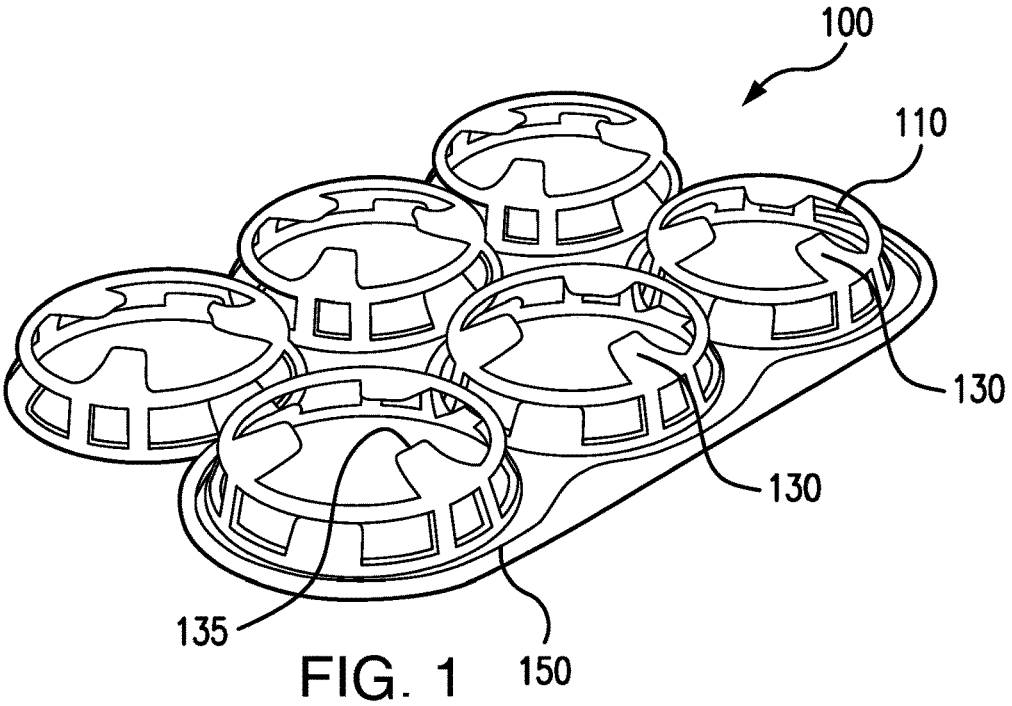
FIG. 1 shows a perspective view of a container carrier according to one embodiment of the invention.
Figure 2:
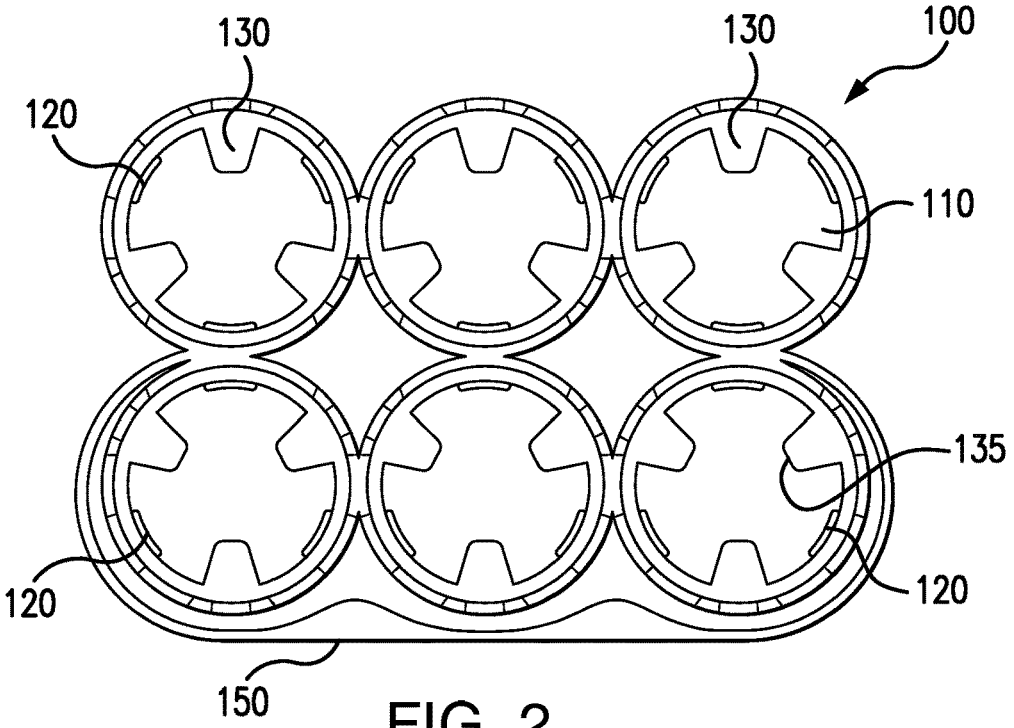
FIG. 2 shows a top plan view of a container carrier according to one embodiment of the invention.
Figure 3:
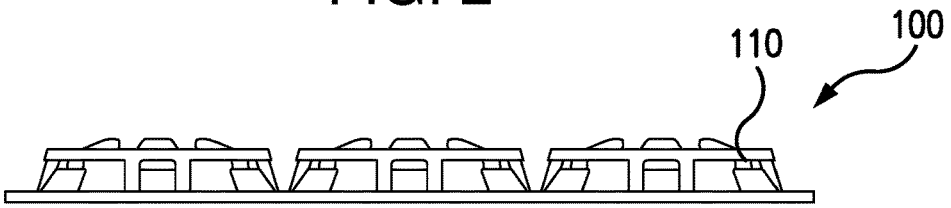
FIG. 3 shows a side view of a container carrier according to one embodiment of the invention.
Figure 4:
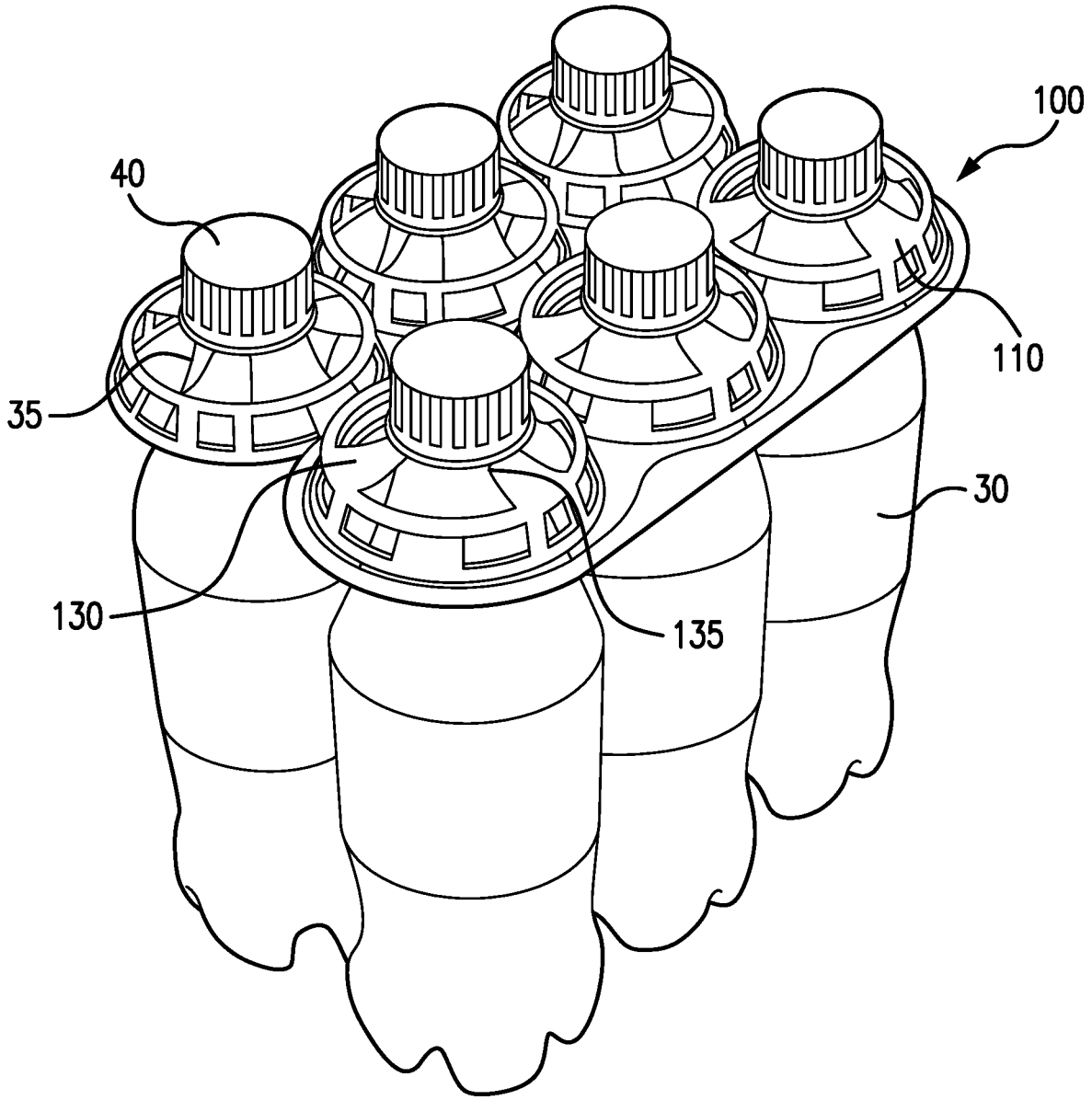
FIG. 4 shows a perspective view of a multipack of bottles according to one embodiment of the invention.
Figure 5:
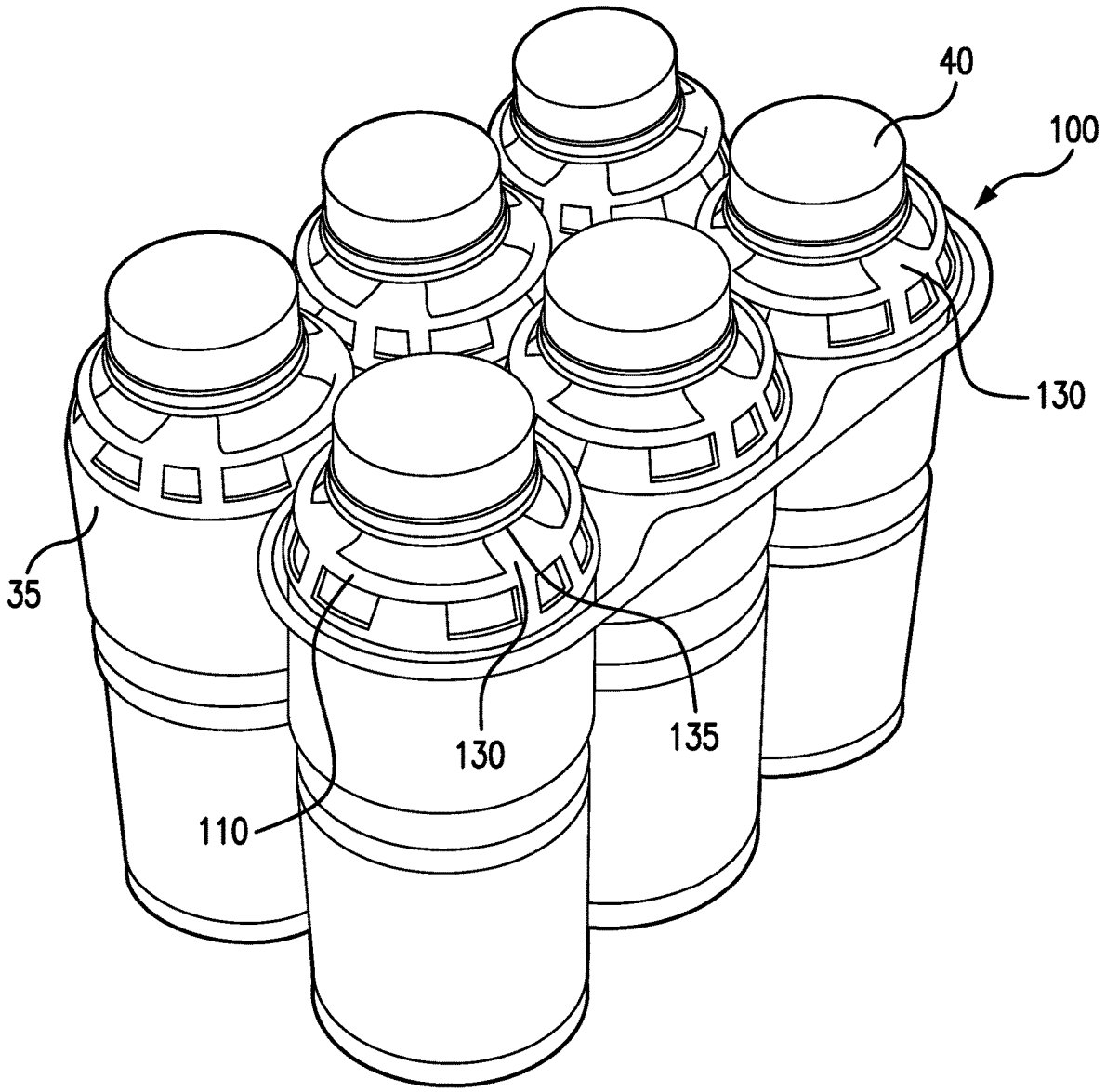
FIG. 5 shows a perspective view of a multipack of bottles according to one embodiment of the invention.

FIGS. 1-6 show one preferred embodiment of a container carrier 100 wherein the first engagement means comprises a plurality of container receiving openings 110 configured to engage with a chime 25 of a can 20 and the second engagement means comprises a plurality of radial tabs 130 positioned within each container receiving opening 110 configured to engage with a cap 40 and/or neck 35 of a bottle 30. As shown in FIGS. 1 and 2, the radial tabs 130 preferably extend inwardly and may include an arcuate leading edge 135 to engage with the cap 40. As shown in FIGS. 4 and 5, the radial tabs 130 preferably flex to permit a range of cap 40 and neck 35 sizes of bottles 30 within the multipack.

The container receiving openings 110 may each include a plurality of circumferential tabs 120 located at spaced locations around the respective container receiving openings to engage with the chime 25.

As best shown in FIG. 2, the container carrier 100 may further include a handle 150 extending along a longitudinal edge of the container carrier 100. In this arrangement, the handle 150 is preferably capable of pivoting over a top of the container carrier 100. As shown, the handle 150 may attach at two opposite ends of the container carrier 100 between transverse container receiving openings 110. The handle 150 may be formed along one or more sides of the container carrier 100 and preferably is graspable so as to form a bail over the top of the multipack. The handle 150 preferably flexes at two attachment points on the container carrier 100 and then extends above the containers so as to permit carrying the multipack in a comfortable manner.

Figure 6:
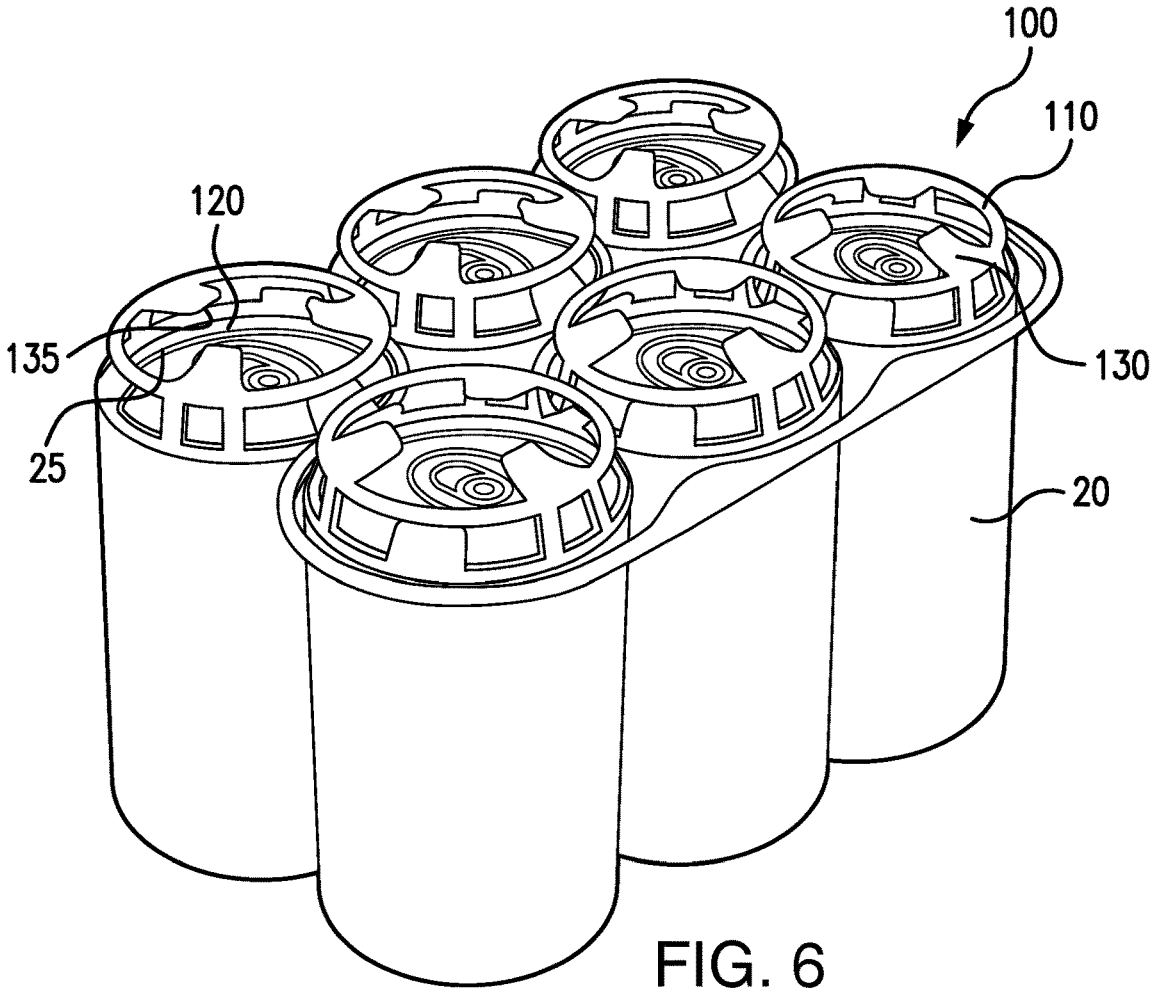
FIG. 6 shows a perspective view of a multipack of cans according to one embodiment of the invention.

As described, the container carrier can accommodate both cans 20 within the outer perimeter of each container receiving opening 110, such as shown in FIG. 6, and also bottles 30, such as shown in FIGS. 4 and 5.

FIGS. 7-12 show an additional embodiment of the container carrier 200. According to this embodiment, the container carrier 200 is formed in a plurality of container rings 210, wherein the first engagement means comprises a plurality of clips 220 extending outwardly from the container rings 210 and the second engagement means comprises a plurality of radial tabs 230 extending inwardly from the container rings 21-.

In addition, a central ring 240 may be formed between each four container rings 210. As a result, in a six pack multipackage as shown in FIGS. 7-12, a total of eight rings form the container carrier 200. The central rings 240 may be used to grasp the resulting multipackage.

Figure 7:
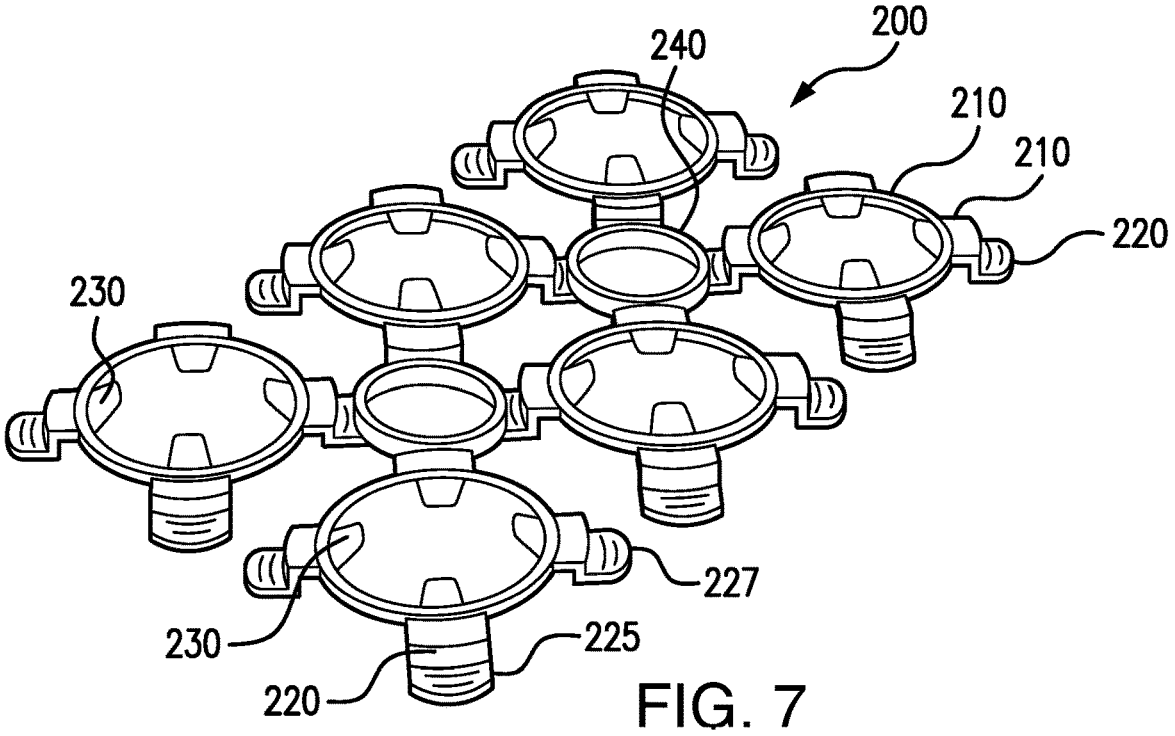
FIG. 7 shows a perspective view of a container carrier according to one embodiment of the invention.
Figure 8:
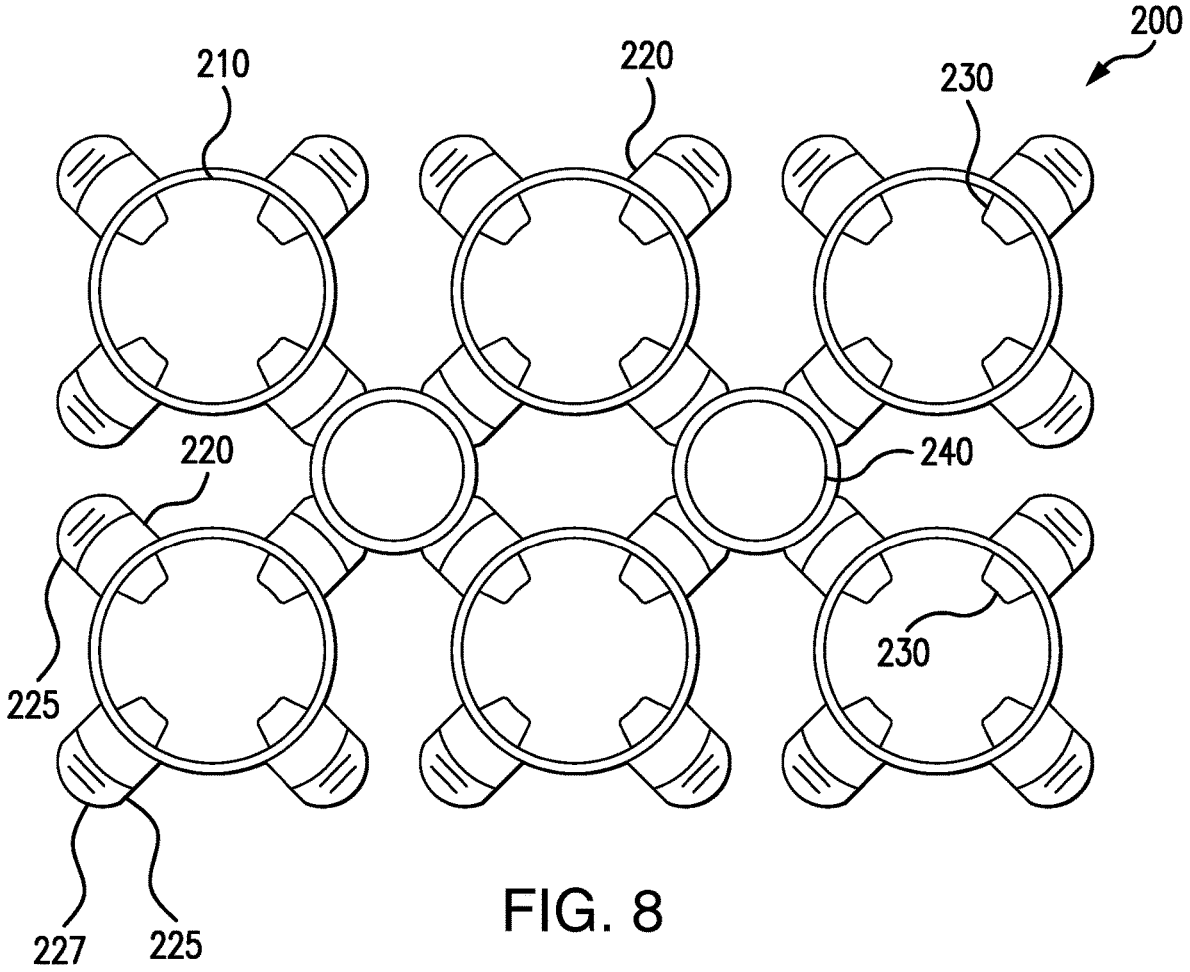
FIG. 8 shows a top plan view of a container carrier according to one embodiment of the invention.
Figure 9:
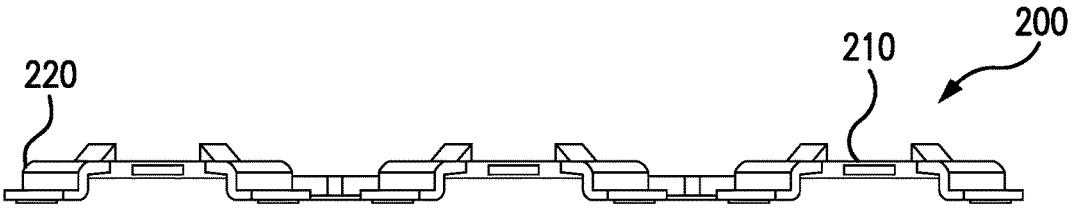
FIG. 9 shows a side view of a container carrier according to one embodiment of the invention.
Figure 10:
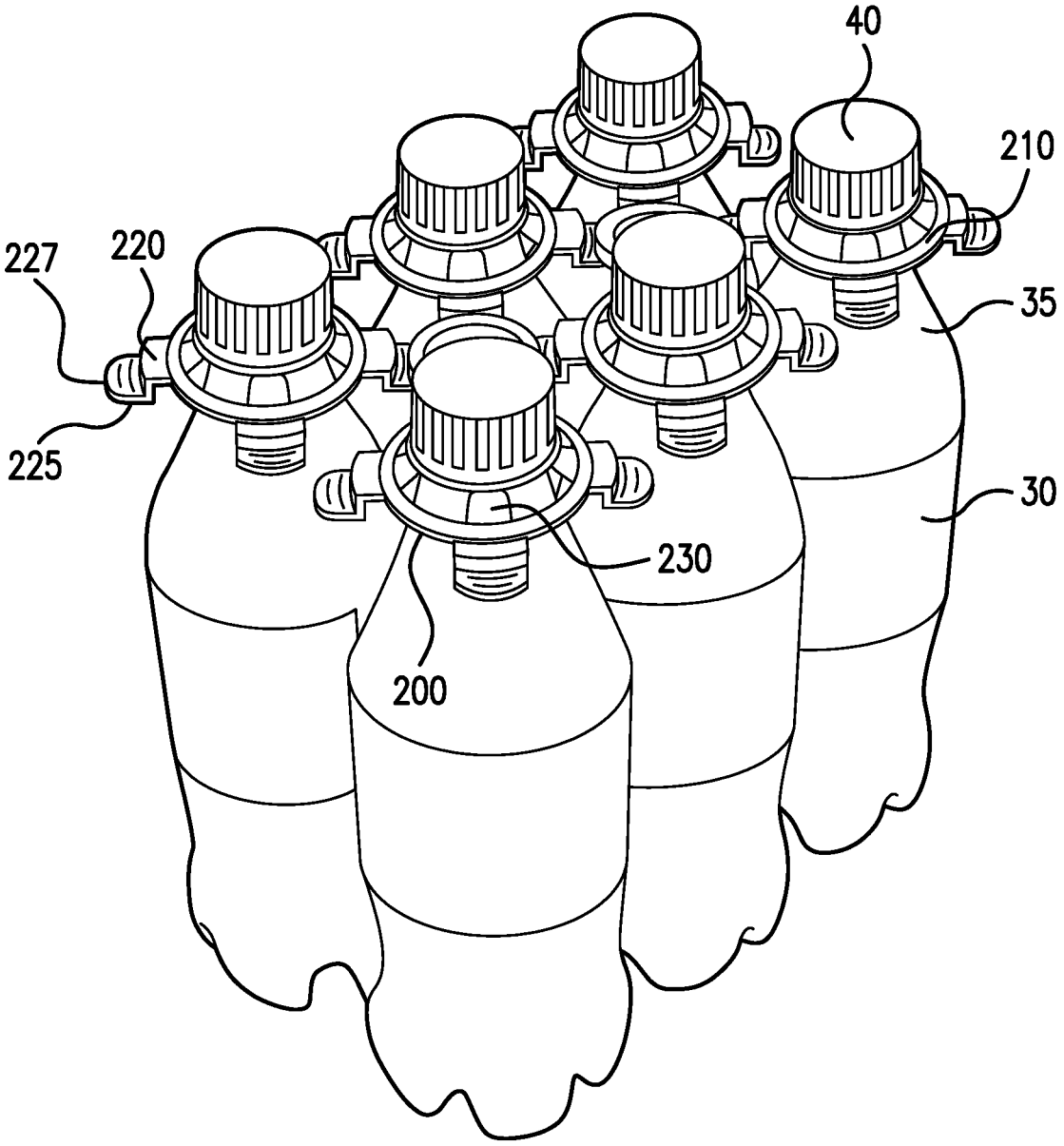
FIG. 10 shows a perspective view of a multipack of bottles according to one embodiment of the invention.

As shown in FIGS. 7 and 9, the plurality of radial clips 220 not only extend outward but also extend downward from the container rings 210. The radial clips 220 include an outwardly extending overhang 225. As best shown in FIGS. 7 and 10, the overhang 225 may include at least one ridge 227. In use, the overhang 225 may be used to pull and release a can 20 from captive placement within the container carrier 200 and the respective ridge(s) 227 may be helpful in permitting a user to take hold of the overhang 225 in order to pull upwards and release the can 20.

In the described arrangement, the radial clips 220 thereby provide a manner of engaging with the chimes 25 of cans 20 so that the respective can is maintained below the container rings 210 in an assembled multipackage.

Figure 11:
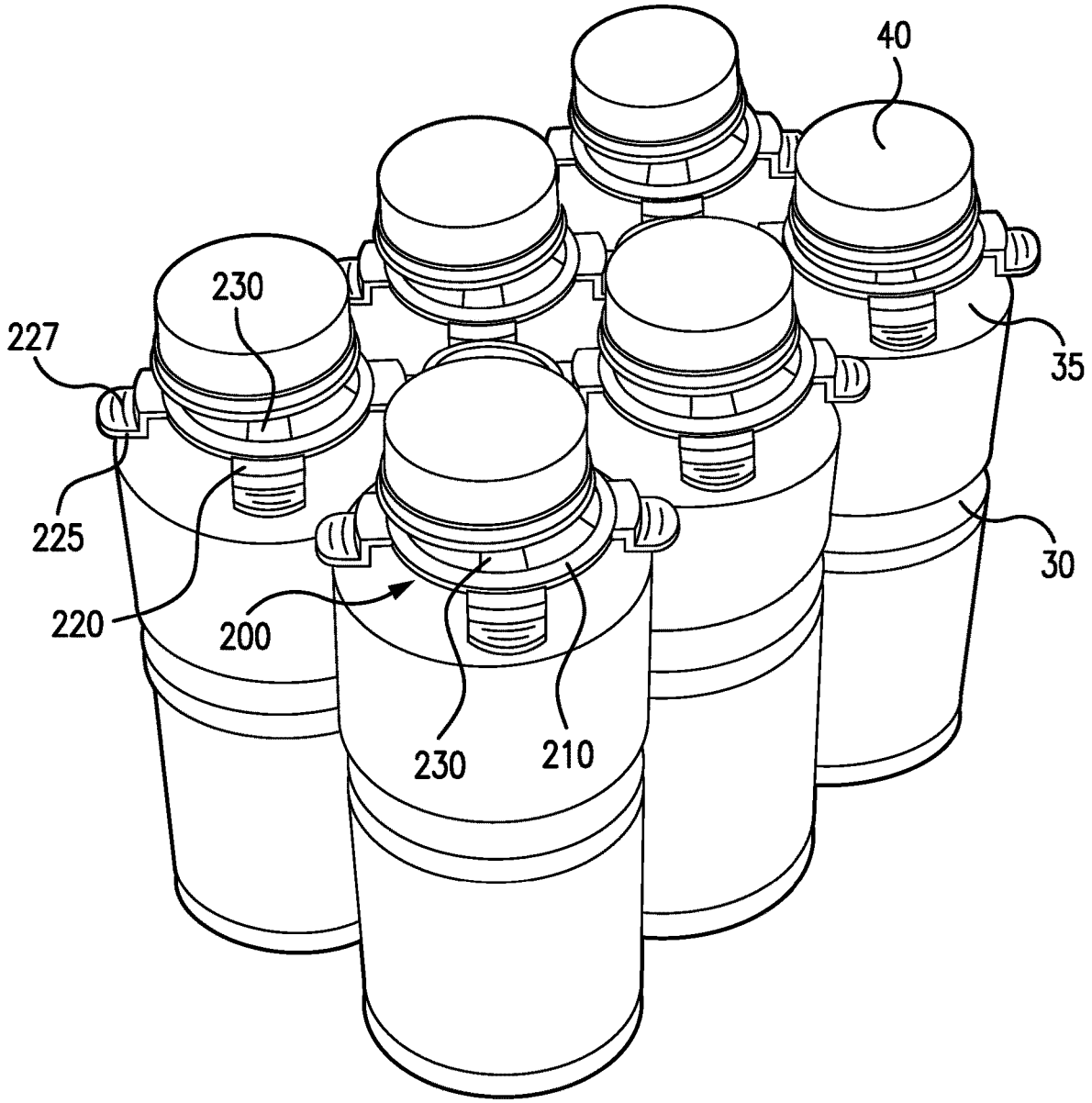
FIG. 11 shows a perspective view of a multipack of bottles according to one embodiment of the invention.
Figure 12:
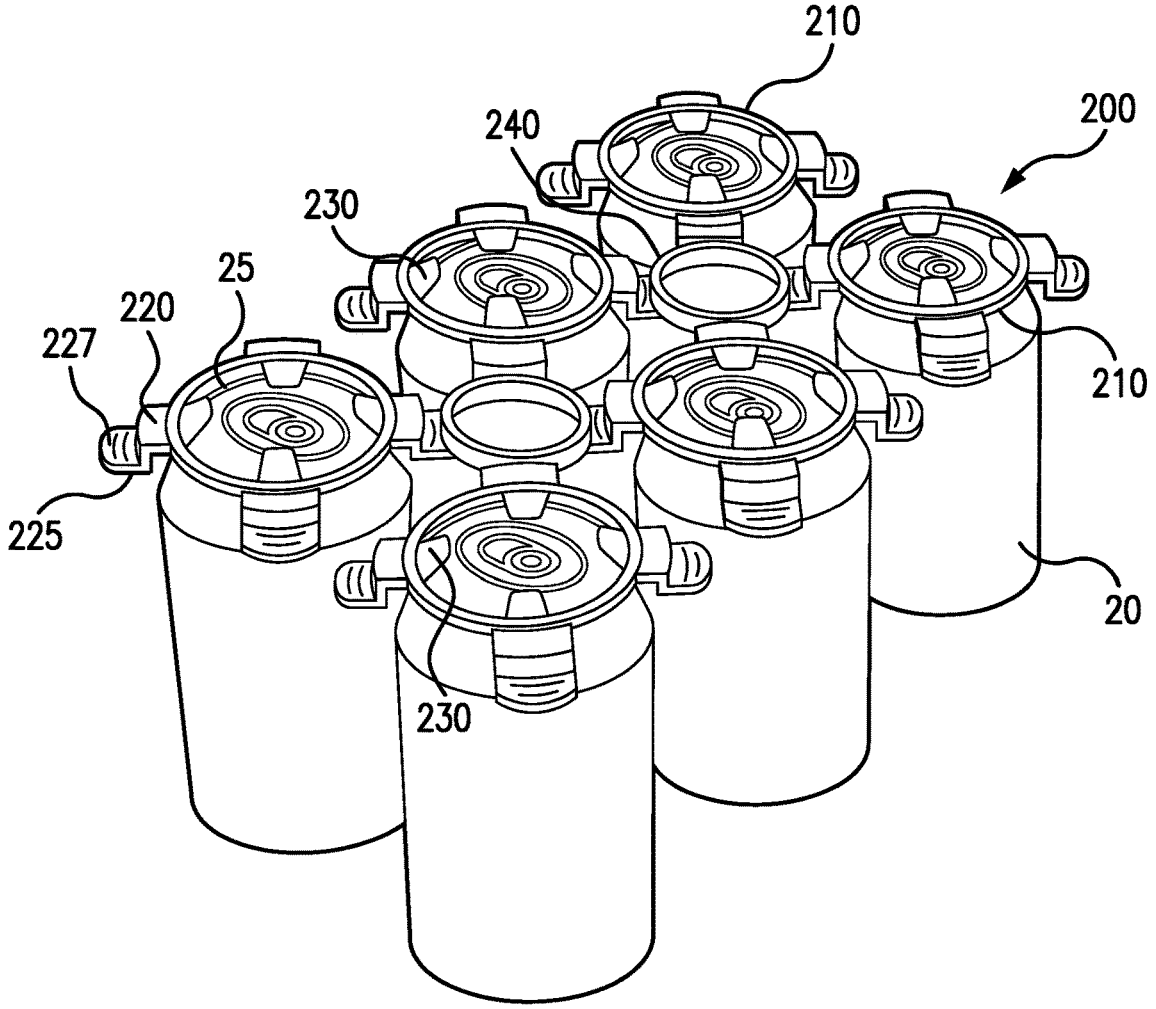
FIG. 12 shows a perspective view of a multipack of cans according to one embodiment of the invention.

The container receiving opening rings 210 further each include three or more radial tabs 230 that extend inward from a perimeter of the respective container ring 210. In this way, the container carrier 200 can accommodate both cans 20 within the perimeter of the radial clips 220, as shown in FIG. 12, but also bottles 30, such as shown in FIGS. 10 and 11. As shown in FIGS. 10 and 11, the radial tabs 230 preferably flex to permit a range of cap 40 and neck 35 sizes of bottles 30 within the multipack.

As shown in FIGS. 13-17, an additional embodiment of the container carrier 300 is shown wherein the first engagement means comprises two or more arcuate clips 320 and the second engagement means comprises an oval aperture 330 configured to accommodate at least two bottles 30.

Figure 16:
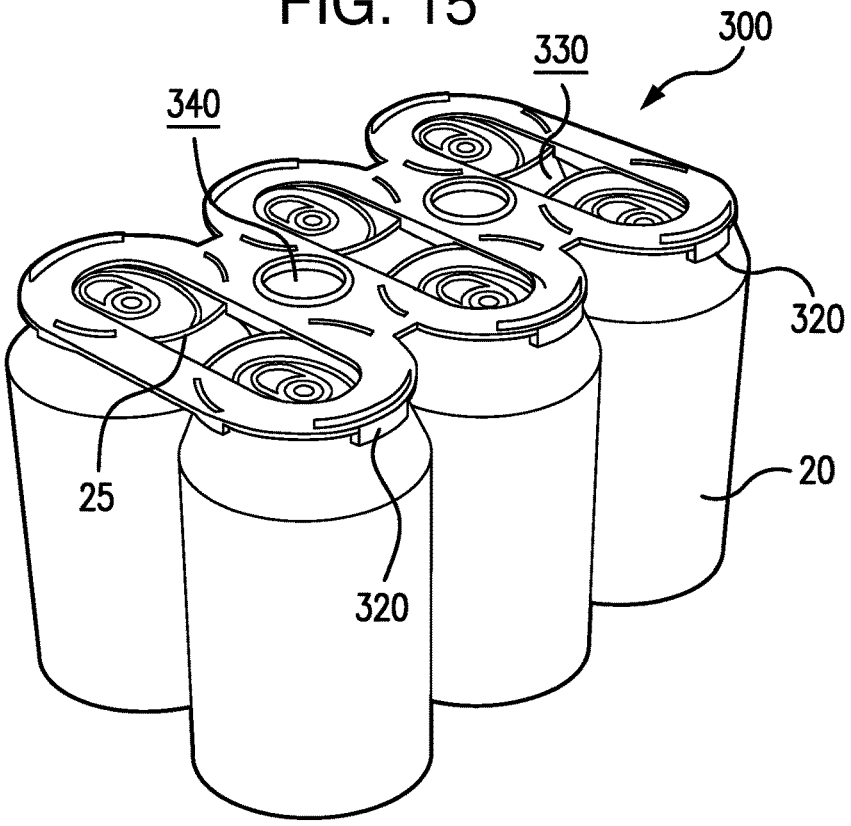
FIG. 16 shows a perspective view of a multipack of cans according to one embodiment of the invention.
Figure 17:
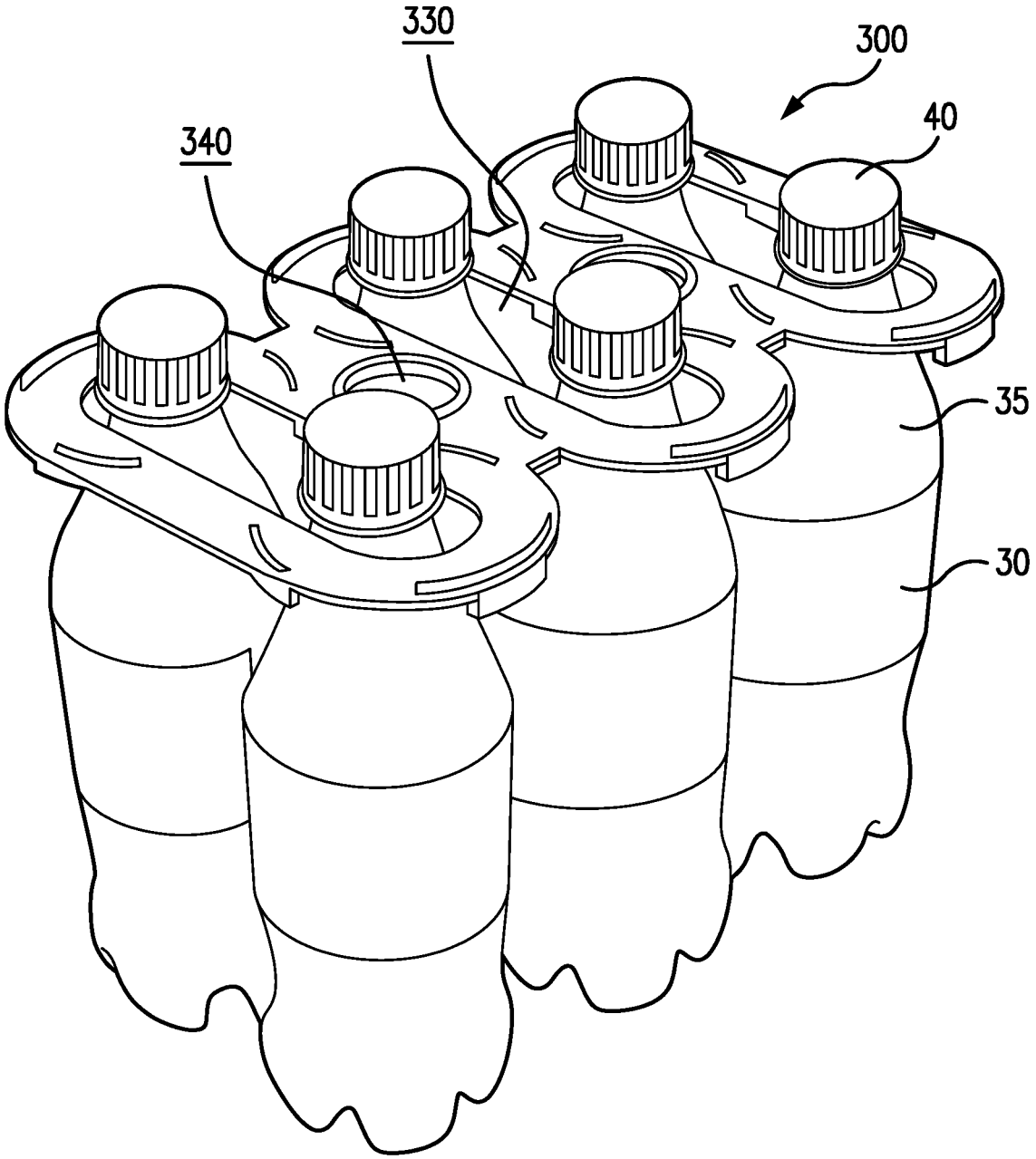
FIG. 17 shows a perspective view of a multipack of bottles according to one embodiment of the invention.

The container carrier 300 as shown preferably includes a pair of container engaging fittings 310 that engage a pair of cans 20 arranged in transverse ranks for each transverse pair of containers. The oval aperture 330 is also preferably positioned within each transverse rank and may extend between each transverse pair of container engaging fittings 310. According to one preferred embodiment, the oval aperture 330 extending between each set of arcuate clips 320 may accommodate a pair of bottle necks 35 and/or caps 40. In this way, the container carrier can accommodate both cans 20 within the arcuate clips 320 of each container receiving fitting 310, as shown in FIG. 16, and also pairs of bottles 30, within respective oval apertures 330, such as shown in FIG. 17.

Figure 13:
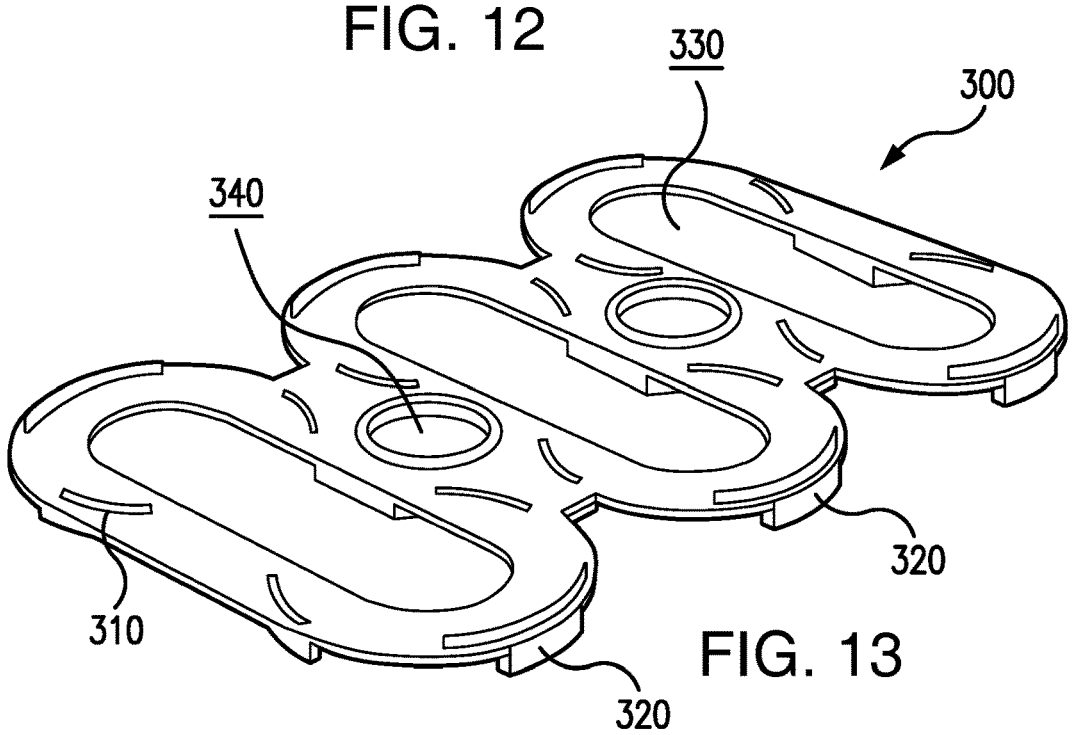
FIG. 13 shows a perspective view of a container carrier according to one embodiment of the invention.
Figure 14:
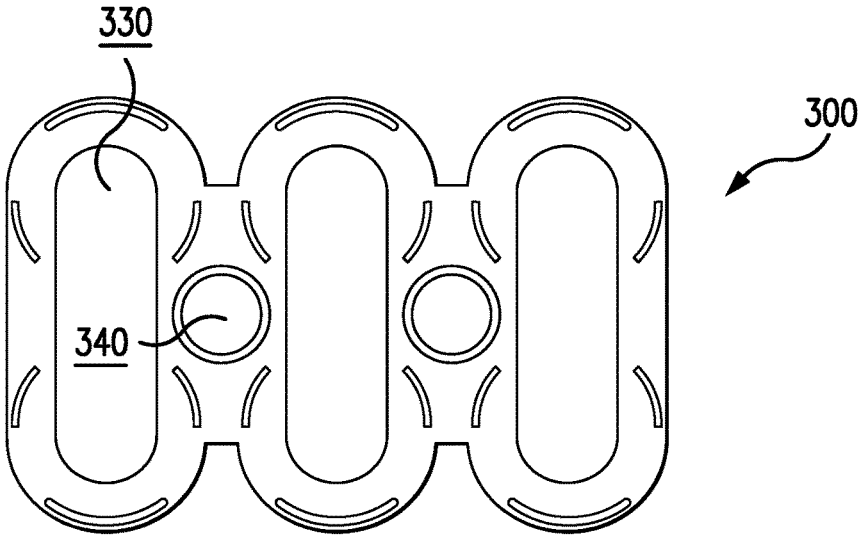
FIG. 14 shows a top plan view of a container carrier according to one embodiment of the invention.
Figure 15:
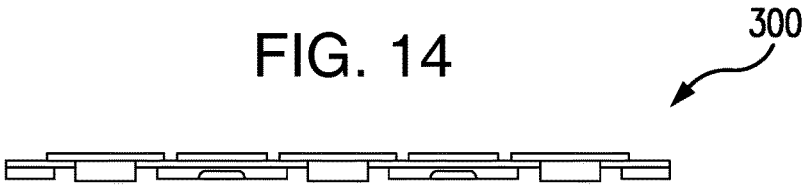
FIG. 15 shows a side view of a container carrier according to one embodiment of the invention.

As best shown in FIGS. 13 and 15, the container carrier 300 preferably includes container receiving fittings 310 formed by a discontinuous series of arcuate clips 320 that together are engageable around a can 20 along a perimeter of each container receiving fitting 310. These arcuate clips 320 are preferably formed in pairs of container receiving fittings 310 within an oval fitting 310 having a corresponding oval aperture 330. In this way, the container receiving fittings 310 may engage with a chime 25 of a can 20 to retain the can 20 within the multipack.

The container carrier 300 may additionally include a pair of gripping apertures 340 formed along a center axis of the container carrier 300. The gripping aperture 340 may be formed as a ring between each four of the container receiving fittings to provide an opening for grasping the multipack. As such, in a six pack arrangement, a pair of gripping apertures 340 are formed between six container receiving fittings.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A container carrier for unitizing a plurality of containers, the container carrier comprising:

a plurality of container receiving openings, each of the plurality of container receiving openings including a first engagement means configured to engage and retain a can around a chime, and a second engagement means configured to engage and retain a bottle, wherein the first engagement means and the second engagement means are generally superimposed upon each other;

an outer perimeter of the each of the plurality of container receiving openings forming the first engagement means, wherein the outer perimeter engages and retains the can; and a plurality of radial tabs inwardly extending from the outer perimeter forming the second engagement means, wherein the plurality of radial tabs engage and retain the bottle.

2. The container carrier of claim 1 wherein the container receiving openings each include a plurality of circumferential tabs to engage with the chime.

3. The container carrier of claim 1 wherein the radial tabs extend inwardly and include an arcuate leading edge to engage with the bottle.

4. The container carrier of claim 1 further comprising a handle extending along a longitudinal edge of the container carrier, the handle capable of pivoting over a top of the container carrier.

5. The container carrier of claim 1 wherein the plurality of radial tabs are positioned within a corresponding one of the plurality of container receiving openings.

6. A container carrier for unitizing a plurality of containers, the container carrier comprising:

a container receiving opening;

an outer perimeter enclosing the container receiving opening, wherein the outer perimeter is a first engagement means configured to engage and retain a can around a chime of the can; and a plurality of radial tabs inwardly extending from the outer perimeter and positioned within the container receiving opening, wherein the plurality of radial tabs is a second engagement means configured to engage and retain a bottle.

7. The container carrier of claim 6, wherein the outer perimeter and the plurality of radial tabs are formed of polyethylene terephthalate (PET) or high density polyethylene (HDPE).

* * * * *